US006354056B1

(12) United States Patent
Korzen

(10) Patent No.: US 6,354,056 B1
(45) **Date of Patent: *Mar. 12, 2002**

(54) APPARATUS AND METHOD FOR PROVIDING A REINFORCED ROOF TRUSS

(76) Inventor: Thomas G. Korzen, 4955 N. Cumberland Ave., Norridge, IL (US) 60656

( * ) Notice: Subject to any disclaimer, the term of this patent is extended or adjusted under 35 U.S.C. 154(b) by 0 days.

This patent is subject to a terminal disclaimer.

(21) Appl. No.: 09/678,055

(22) Filed: Oct. 3, 2000

Related U.S. Application Data

(63) Continuation of application No. 09/216,600, filed on Dec. 18, 1998, now Pat. No. 6,145,268.

(51) Int. Cl.[7] ..... E04B 1/18

(52) U.S. Cl. ..... 52/712; 52/633; 52/639; 52/714; 52/223.8; 52/223.9; 52/223.1

(58) Field of Search ..... 52/633, 712, 714, 52/639, 223.8, 223.9, 223.1

(56) References Cited

U.S. PATENT DOCUMENTS

| | | | | |
|---|---|---|---|---|
| 187,513 A | | 2/1877 | Colby | 52/639 |
| 4,897,979 A | | 2/1990 | Colonias | 52/639 |
| 4,932,173 A | | 6/1990 | Commins | 52/712 |
| 6,145,268 A | * | 11/2000 | Korzen | 52/712 |

OTHER PUBLICATIONS

Roof Truss Repair and Reinforcement Quote—by Thonmas G. Korzen—Feb. 26, 1997.
Roof Truss Repair and Reinforcement Quote—by Thomas G. Korzen—Sep. 23, 1997.
Purchase Requisition—Jul. 29, 1997.
Purchase Requisition—Dec. 19, 1997.

* cited by examiner

*Primary Examiner*—Carl D. Friedman
*Assistant Examiner*—Christy M. Syres
(74) *Attorney, Agent, or Firm*—Welsh & Katz, Ltd.

(57) ABSTRACT

A reinforced truss includes a pre-existing top chord and a pre-existing bottom chord, a reinforcing top chord, first and second reinforcing chord heel plates, each of the reinforcing chord heel plates having a plate, a reinforcing truss bracket attached to a first end of the plate, at least one slotted aperture disposed on the plate and spaced to approximately match a pre-existing bolt pattern of the pre-existing truss, and a tie rod bracket. The ends of the reinforcing top chord are captured in the reinforcing truss brackets of the reinforcing chord heel plates. A tie rod is connected to the tie rod brackets of the first and second reinforcing chord heel plates. The slotted aperture allows for the tie rod to be adjusted, thereby adjusting the loading on the reinforcing top chord.

12 Claims, 2 Drawing Sheets

APPARATUS AND METHOD FOR PROVIDING A REINFORCED ROOF TRUSS

This invention relates to trusses. In particular, the invention relates to reinforcing roof trusses having an adjustable reinforcing chord heel plate. This is a continuation of application Ser. No. 09/216,600, filed Dec. 18, 1998, now U.S. Pat. No. 6,145,268.

BACKGROUND

Trusses to support a convex roof are well known. Many such trusses are made of wood, and can span more than 100 feet in length. Wooden trusses are subject to rot, splitting, cracking, insect infestations, or other forms of age-related degradation. Additionally, the load placed on a wooden truss may exceed the original expected loading for the truss for a variety of reasons, including the addition of hoists, machinery such as heating, ventilating, and air conditioning equipment, or additional layers of exterior roofing materials. Existing trusses may require reinforcement for any of these or other reasons.

Known trusses generally have one or more top chords, which are subject to compression loading, and one or more bottom chords, which are subject to tension loading. The top and bottom chords are typically connected at a heel connection setting plate. One known way of reinforcing such a truss is to install additional top chords from end to end of the truss. At the heel connection, the new top chords were simply clamped to the setting plate. A problem with the known way to reinforce a truss is that clamping the top chord down to the setting plate did not prevent the top chord from sliding out.

SUMMARY

The present invention provides for installing a reinforcing chord heel plate that engages the loading of the reinforcing top chords into the loading of the existing top chords, so both the old and new top chords work together.

The present invention for reinforcing a pre-existing truss provides for a reinforcing chord heel plate having a reinforcing truss bracket, apertures spaced to match bolt patterns from a top chord of the pre-existing truss, and a tie rod bracket.

The present invention also provides for a reinforced truss having a pre-existing top chord, a reinforcing top chord, a bottom chord, first and second reinforcing chord heel plates, each reinforcing chord heel plate having a reinforcing truss bracket, apertures spaced to match bolt patterns from a top chord of the pre-existing truss, and a tie rod bracket, the reinforcing top chord having a first end captured in the reinforcing truss bracket of the first reinforcing chord heel plate and a second end captured in the reinforcing truss bracket of the second reinforcing chord heel plate, and a tie rod connecting the first and second reinforcing heel plates.

DETAILED DESCRIPTION

Figure 1:
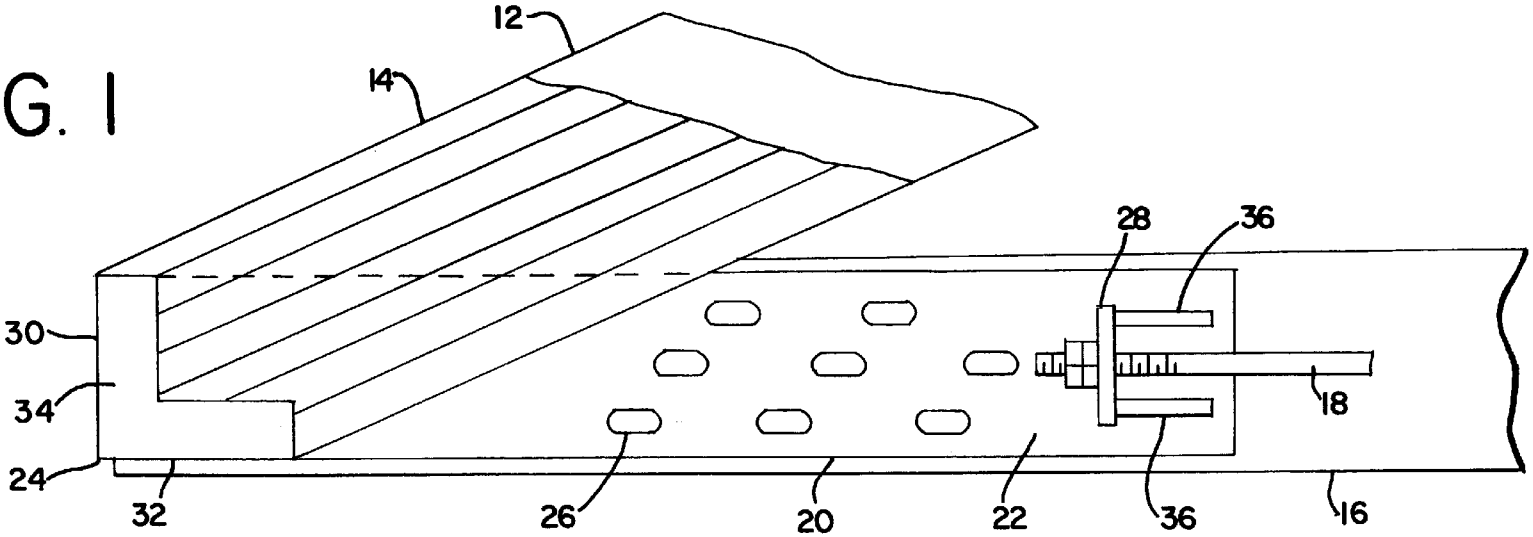
FIG. 1 shows one example of a truss heel of the present invention.

Known trusses generally have one or more top chords and one or more bottom chords. The top and bottom chords are typically connected at a heel connection setting plate. The bottom chords may be connected to the setting plates with lag bolts.

Referring now to FIGS. 1–4, a reinforced truss 10 of the present invention includes a pre-existing top chord 12, a reinforcing top chord 14, a bottom chord 16, a tie rod 18, and first and second reinforcing chord heel plates 20. In the illustrated embodiment, there are two reinforcing top chords 14, one installed on either side of two preexisting top chords 12. Also, there are four reinforcing chord heel plates 20, one for each end of the two reinforcing top chords 14.

The reinforcing chord heel plate 20 of the present invention has a plate 22, reinforcing truss bracket 24 attached to a first end of the plate 22, at least one slotted aperture 26, and preferably, a plurality of slotted apertures 26 disposed on the plate 22 and spaced to approximately match bolt patterns from a top chord of the pre-existing truss, and a tie rod bracket 28. The reinforcing chord heel plate 20 may be fabricated from steel.

Figure 2:
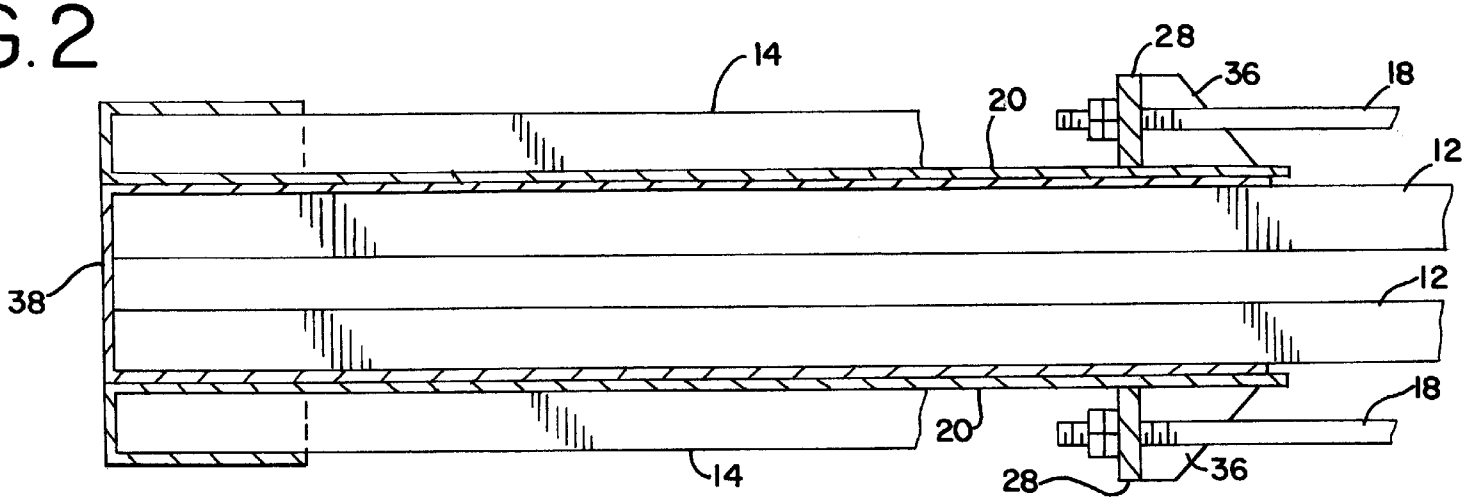
FIG. 2 shows a plain view of one example of a truss heel of the present invention.
Figure 3:
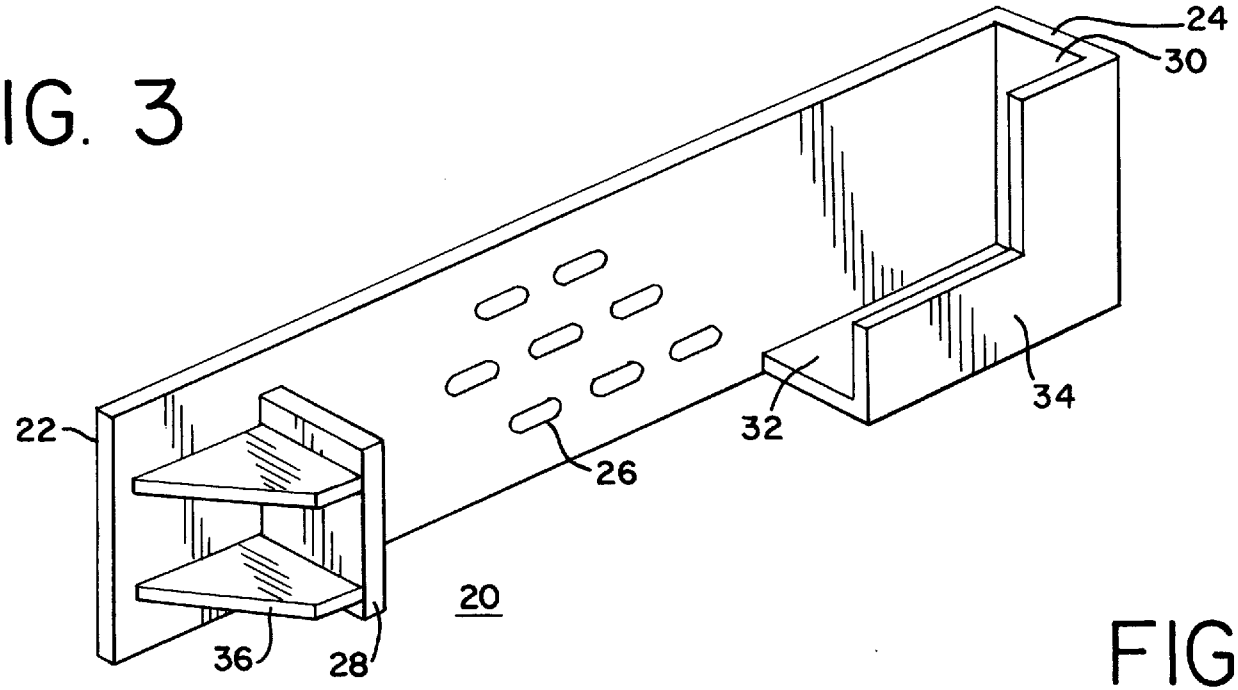
FIG. 3 Shows a perspective view of one example of a reinforcing chord heel plate of the present invention.
Figure 4:
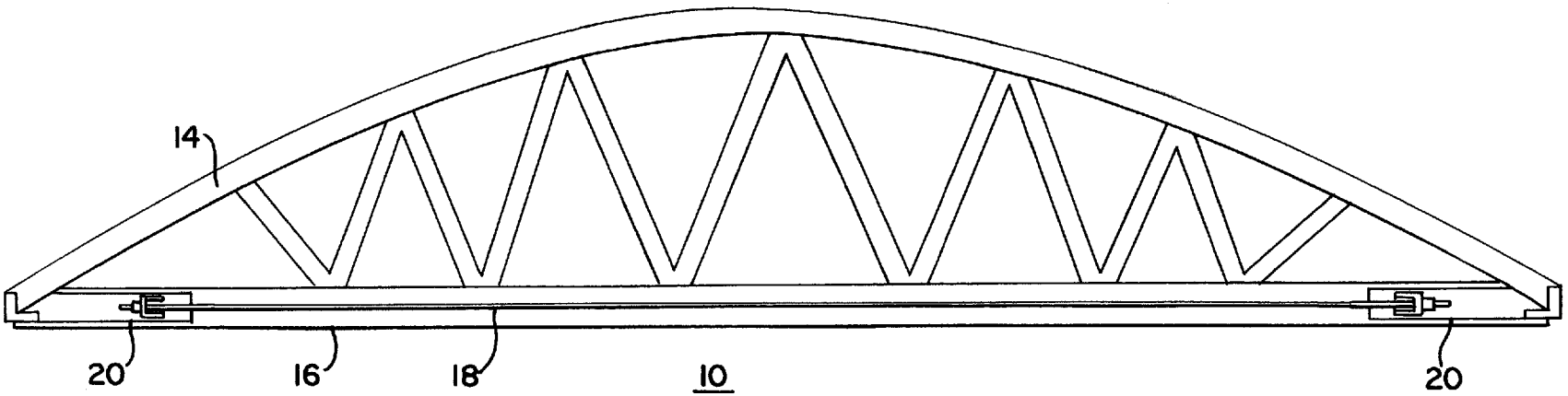
FIG. 4 shows one example of a reinforced truss of the present invention.

In the embodiment illustrated in FIGS. 2–4, the reinforcing truss bracket 22 comprises a pair of planar bracket surfaces 30 and 32 extending at ninety degree angles to each other and to the plate 22. These surfaces form an "L" shaped bracket. The reinforcing truss bracket 22 illustrated in the Figures may further comprise a third bracket surface 34, parallel to the plate 22 and attached to the bracket surfaces 30 and 32 for further security in capturing the reinforcing top chord 20. The reinforcing truss bracket 24 may be formed integrally with the plate 22, or separately fabricated and later attached. For example, the pair of bracket surfaces 30 and 32 may be welded onto plate 22, and third bracket surface 34 may be welded to bracket surfaces 30 and 32. Alternatively, an angle iron may be used to form bracket surface 30 and a portion of bracket surface 34, while another angle iron may be used to form bracket surface 32 and the remainder of bracket surface 34. Also, various shapes and configurations of the reinforcing truss bracket 24 may be substituted for the illustrated reinforcing truss bracket 24 without departing from the spirit of the invention.

The slotted apertures 26 are disposed on the plate 22 to approximately match the bolt pattern of the pre-existing truss. The slotted apertures 26 are longer horizontally than vertically.

The tie rod bracket 28 is located at a second end of the plate 22. The tie rod bracket 28 may be a simple planar surface extending from the plate 22. As illustrated, the tie rod bracket 28 includes reinforcing members 36. The tie rod bracket 28 may be formed integrally with the plate 22, or separately fabricated and later attached. For example, tie rod bracket 28 and reinforcing members 36 may be welded onto plate 22. Various shapes and configurations of the tie rod bracket 28 may be substituted for the illustrated tie rod bracket 28 without departing from the spirit of the invention.

In the reinforced truss 10, the reinforcing top chord 14 has a first end captured in the reinforcing truss bracket 24 of the first reinforcing chord heel plate 20 and a second end captured in the reinforcing truss bracket 24 of the second reinforcing chord heel plate 20. The tie rod 18 connects the first and second reinforcing heel plates 20 via the tie rod brackets 28 of each reinforcing heel plate 20.

In use, the reinforcing top chord 14 is cut to fit the span of the pre-existing top chord 12 and to fit the reinforcing top chord 14 brackets of the reinforcing chord heel plates 20. Each reinforcing chord heel plate 20 is installed by loosely bolting the reinforcing chord heel plate 20 through the bottom chord (or chords) 16 and the pre-existing setting plates 38. The tie rods 18 are installed on the tie rod brackets 28, but not tightened. The reinforcing top chord 14 is installed, with its ends captured in the reinforcing top chord 14 brackets. At this time, the tie rods are tightened until the reinforcing top chord 14 is sufficiently compressed to support the loading of the roof. The slotted apertures 26 of the plate 22 allow the reinforcing chord heel plates 20 to be drawn together and compress the top reinforcing chord 14. When the tie rods 18 have been tightened, the bolts are tightened, and the plate 22 is fixed in place.

Specific embodiments of the truss reinforcement method and apparatus have been described herein for purposes of illustrating the manner in which the invention may be made and used. It should be understood that implementation of other variations and modifications of the invention in its various aspects will be apparent to those skilled in the art, and that the invention is not limited thereto by the specific embodiments described. It is therefore contemplated to cover by the present invention any and all modifications, variations or equivalence that fall within the true spirit and scope of the basic underlying principles disclosed and claimed herein.

In describing and claiming the present invention, the use of the indefinite article "a" means "at least one," and should not be limited to "only one" unless explicitly indicated to the contrary. The descriptions of the trusses being made of wood is not intended to be a limitation of the present invention unless the building material is expressly recited in the claims.

What is claimed is:

1. A reinforcing chord heel plate for installing a reinforcing top chord on a pre-existing convex roof truss, comprising:

a plate;

a reinforcing truss bracket attached to the plate and adapted to receive the reinforcing top chord;

at least one slotted aperture disposed on the plate and spaced to approximately match a pre-existing bolt pattern of the pre-existing convex roof truss; and a tie rod bracket.

2. The reinforcing chord heel plate of claim 1, wherein the reinforcing truss bracket comprises a pair of planar bracket surfaces extending from the plate.

3. The reinforcing chord heel plate of claim 2, wherein the reinforcing truss bracket further comprises a third bracket surface parallel to the plate and attached to the pair of planar bracket surfaces.

4. The reinforcing chord heel plate of claim 1, wherein the reinforcing truss bracket is integrally formed with the plate.

5. The reinforcing chord heel plate of claim 1, wherein the slotted aperture comprises a plurality of slotted apertures.

6. The reinforcing chord heel plate of claim 1, wherein the slotted aperture is longer horizontally than vertically.

7. A convex roof truss comprising:

a first convex top chord, having first and second ends;

a bottom chord, having a first end attached to the first end of the first convex top chord, and a second end attached to the second end of the first convex top chord;

a first chord heel plate having a plate, a reinforcing truss bracket attached to a first end of the plate, at least one slotted aperture disposed on the plate for adjustable attachment of the first chord heel plate to the first end of the first convex top chord and to the first end of the bottom chord, and a tie rod bracket;

a second chord heel plate having a plate, a reinforcing truss bracket attached to a first end of the plate, at least one slotted aperture disposed on the plate for adjustable attachment of the first chord heel plate to the second end of the first convex top chord and to the second end of the bottom chord, and a tie rod bracket;

a second convex top chord, having first and second ends;

the first end of the second convex top chord captured in the reinforcing truss bracket of the first reinforcing chord heel plate and the second end of the second convex top chord captured in the reinforcing truss bracket of the second reinforcing chord heel plate; and a first tie rod connected to the tie rod brackets of the first and second reinforcing chord heel plates.

8. The convex roof truss of claim 2, wherein:

the first end of the bottom chord is bolted to the first end of the first convex top chord in a first bolt pattern, and the second end of the bottom chord is bolted to the second end of the first convex top chord in a second bolt pattern;

the slotted aperture of the first chord heel plate is adapted to match the first bolt pattern, the first chord heel plate being bolted to the first ends of the bottom chord and the first convex top chord; and the slotted aperture of the second chord heel plate is adapted to match the second bolt pattern, the second chord heel plate being bolted to the second ends of the bottom chord and the first convex top chord.

9. The reinforced truss of claim 8, wherein the slotted aperture of each chord heel plate comprises a plurality of slotted apertures, and wherein the slotted apertures are longer horizontally than vertically.

10. The convex roof truss of claim 9, further comprising:

a third chord heel plate having a plate, a reinforcing truss bracket attached to a first end of the plate, at least one slotted aperture disposed on the plate for adjustable attachment of the third chord heel plate to the first end of the first convex top chord and to the first end of the bottom chord, and a tie rod bracket;

a fourth chord heel plate having a plate, a reinforcing truss bracket attached to a first end of the plate, at least one slotted aperture disposed on the plate for adjustable attachment of the fourth chord heel plate to the second end of the first convex top chord and to the second end of the bottom chord, and a tie rod bracket;

a third convex top chord, having first and second ends;

the first end of the third convex top chord captured in the reinforcing truss bracket of the third reinforcing chord heel plate and the second end of the third convex top chord captured in the reinforcing truss bracket of the fourth reinforcing chord heel plate; and a second tie rod connected to the tie rod brackets of the third and fourth reinforcing chord heel plates.

11. The convex roof truss of claim 10, wherein:

the first end of the bottom chord is bolted to the first end of the first convex top chord in a first bolt pattern, and the second end of the bottom chord is bolted to the second end of the first convex top chord in a second bolt pattern;

the slotted aperture of the first chord heel plate is adapted to match the first bolt pattern, the first chord heel plate being bolted to the first ends of the bottom chord and the first convex top chord;

the slotted aperture of the second chord heel plate is adapted to match the second bolt pattern, the second chord heel plate being bolted to the second ends of the bottom chord and the first convex top chord;

the slotted aperture of the third chord heel plate is adapted to match the first bolt pattern, the third chord heel plate being bolted to the first ends of the bottom chord and the first convex top chord on a side opposite the first chord heel plate; and the slotted aperture of the fourth chord heel plate is adapted to match the second bolt pattern, the fourth chord heel plate being bolted to the second ends of the bottom chord and the first convex top chord on a side opposite the second chord heel plate.

12. The reinforced truss of claim 11, wherein the slotted aperture of each chord heel plate comprises a plurality of slotted apertures, and wherein the slotted apertures are longer horizontally than vertically.

* * * * *